US006795681B2

(12) United States Patent
Onodera et al.

(10) Patent No.: US 6,795,681 B2
(45) Date of Patent: Sep. 21, 2004

(54) FIXING DEVICE CONTROLLING METHOD, FIXING DEVICE, AND IMAGE FORMING APPARATUS FOR FORMING FIXED IMAGES OF DESIRED GLOSSINESS

(75) Inventors: Masahiro Onodera, Tokyo (JP); Hiroshi Fuma, Hachioji (JP); Junichi Hamada, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/273,559

(22) Filed: Oct. 18, 2002

(65) Prior Publication Data

US 2003/0091360 A1 May 15, 2003

(30) Foreign Application Priority Data

Oct. 26, 2001 (JP) ..... 2001-328638
Nov. 13, 2001 (JP) ..... 2001-347883

(51) Int. Cl.[7] ..... G03G 15/20
(52) U.S. Cl. ..... 399/341; 399/69; 399/329
(58) Field of Search ..... 399/341, 69, 67, 399/322, 331, 329

(56) References Cited

U.S. PATENT DOCUMENTS 4,639,405 A * 1/1987 Franke ..... 399/331
5,887,234 A * 3/1999 Aslam et al. ..... 399/322
5,887,235 A * 3/1999 Wayman et al. ..... 399/329
5,890,032 A * 3/1999 Aslam et al. ..... 399/69
6,088,546 A * 7/2000 Inoue et al. ..... 399/67
6,101,345 A * 8/2000 Van Goethem et al. ..... 399/69
6,505,028 B1 * 1/2003 Yoda et al. ..... 399/329
2002/0146258 A1 * 10/2002 Iida et al.

FOREIGN PATENT DOCUMENTS

JP 04342275 A * 11/1992 ..... G03G/15/20
JP 05072939 A * 3/1993 ..... G03G/15/20
JP 09190107 A * 7/1997 ..... G03G/15/20
JP 11084770 A * 3/1999 ..... G03G/15/00
JP 2001042699 A * 2/2001 ..... G03G/15/20

* cited by examiner

*Primary Examiner*—Susan Lee
(74) *Attorney, Agent, or Firm*—Frishauf, Holtz, Goodman & Chick, P.C.

(57) ABSTRACT

In a method of controlling a fixing device having a heating roller containing a heat source, at least one supporting roller spaced from the heating roller, a fixing belt trained about the heating roller and the supporting roller, and a pressing roller placed to form a nipping area between the fixing belt and the pressing roller, giving a pressing force to the heating roller or the supporting roller through the fixing belt, the method includes the steps of: presetting a desired glossiness of fixed images; detecting a temperature of the pressing roller; calculating a target heating roller temperature from the preset glossiness of fixed images, the detected temperature of the pressing roller, a calculated loaded nipping time, a false nipping time, and a loaded nipping surface pressure; and controlling an operating status of the heat source according to the calculated target heating roller temperature.

9 Claims, 6 Drawing Sheets

FIXING DEVICE CONTROLLING METHOD, FIXING DEVICE, AND IMAGE FORMING APPARATUS FOR FORMING FIXED IMAGES OF DESIRED GLOSSINESS

BACKGROUND OF THE INVENTION

The present invention relates to a method of controlling a fixing device, the fixing device and an image forming apparatus equipped with the fixing device.

In general, electro-photographic image forming apparatus is equipped with a hot-press type fixing device to fix toner images that are formed but unfixed on transfer sheets or recording materials. Among such hot-press type fixing devices, a well-known fixing device that provides a comparatively stable fixability (also referred to as fixing performance) comprises, for example, a heating roller containing a heat source such as a heater lamp, a supporting roller that is in parallel with the heating roller with a space between them, a fixing belt that is trained about the heating roller and the supporting roller, and a pressing roller that is placed to form a nipping area between the fixing belt and the pressing roller and gives a pressing force to the heating roller or the supporting roller via the fixing belt.

In the fixing device of this belt type, the pressing roller comprises a core bar made of metal such as aluminum and an elastic layer made of elastic material such as silicone rubber that covers the surface of the core bar.

This kind of fixing device is equipped with a temperature detecting means for detecting the temperature of the pressing roller. The fixing device sets the target temperature of the heating roller for optimum fixing according to temperature information sent from the temperature detecting means, causes a proper controlling mechanism to control turning on and off the heater lamp in the heating roller, and thus keeps the temperature of the nipping area at a preset temperature.

However, this controlling method that sets the target temperature of the heating roller from only temperature information sent from the temperature detecting means cannot keep the expected fixability (fixing performance) steadily as the hardness of the elastic material constituting the elastic layer around the surface of the pressing roller goes down when the fixing device is used for a long time or when the operating environment of the fixing device such as ambient temperature and humidity changes. Consequently, this kind of fixing device cannot be free from a problem that the formed images may have uneven glossiness.

Further, when a fixing condition such as the moving speed of the fixing belt or the fixing load changes, the fixing performance cannot be the same. Therefore, the fixing device cannot form images of even glossiness independently of the fixing process conditions.

Further, the conventional fixing devices have problems as explained below.

Glossiness of fixed images is one of the most significant image characteristics. As the glossiness of fixed images is dependent upon the fixing process conditions, the optimum fixing condition is set according to the expected glossiness of the fixed images. However, to change the glossiness of the fixed images, it is necessary to determine another optimum fixing process conditions by trial and error. This is a complicated and time-consuming work.

Even when an optimum fixing condition is set, for example, the hardness of the elastic material covering the pressing roller goes lower as the fixing device is used longer and the nipping width and the nipping surface pressure vary. In other words, the fixing process condition varies substantially. Therefore, it is difficult to form fixed images of the expected glossiness.

Further, the fixing device cannot be free from a problem that fixed images do not have uniform glossiness when the operating environment such as ambient temperature and humidity of the fixing device varies.

SUMMARY OF THE INVENTION

In view of the foregoing, a first object of the invention is to provide a method of controlling a fixing device to steadily retain a desired fixability (fixing performance) for a long time independently of a change or fluctuation in the fixing process condition or change in the operating condition.

A second object of the invention is to provide a fixing device that steadily retains a desired fixability (fixing performance) for a long time independently of a change or fluctuation in the fixing process condition or change in the operating condition.

A third object of the invention is to provide an image forming apparatus that steadily retains a desired fixability (fixing performance) for a long time independently of a change or fluctuation in the fixing process condition or change in the operating condition and steadily forms images of uniform glossiness.

A fourth object of the invention is to provide a method of controlling a fixing device that forms fixed images of a desired glossiness easily and steadily for a long time and that steadily forms fixed images of a desired glossiness independently of changes in the operating environment or the like.

A fifth object of the invention is to provide a fixing device that forms fixed images of a desired glossiness easily and steadily for a long time and that steadily forms fixed images of a desired glossiness independently of changes in the operating environment or the like.

A sixth object of the invention is to provide an image forming apparatus that forms fixed images of a desired glossiness easily and steadily for a long time and that steadily forms fixed images of a desired glossiness independently of changes in the operating environment or the like.

The above-described first through third objects can be accomplished by one of the structures below.

A method of controlling a fixing device comprising a heating roller containing a heat source, at least one supporting roller that is in parallel with the heating roller with a space between them, a fixing belt that is trained about the heating roller and the supporting roller, and a pressing roller that is placed to form a nipping area between the fixing belt and the pressing roller and gives a pressing force to the heating roller or the supporting roller via the fixing belt, wherein said method comprises the steps of (i) detecting the temperature of said pressing roller, (ii) calculating a target heating roller temperature (a) from a detected temperature (b) of the pressing roller obtained in said step (i), a loaded nipping time (c) calculated by Expression (1) below, a false nipping time (d) calculated by Expression (2) below, and a loaded nipping surface pressure (e) calculated by Expression (3) below, and (iii) controlling the operating status of the heat source in said heating roller from the target heating roller temperature (a) obtained in step (ii).

$$\text{Loaded nipping time } (c) = L1/V \qquad \text{Expression (1)}$$

$$\text{False nipping time } (d) = L2/V \qquad \text{Expression (2)}$$

$$\text{Loaded nipping surface pressure } (e) = P/(L1 \times W) \qquad \text{Expression (3)}$$

In Expressions (1) to (3), L1 is the width of the fixing belt along the movement of the fixing belt in the surface area of the fixing belt sandwiched by the pressing roller and the supporting roller or the heating roller, L2 is the width of the fixing belt in the area in contact with the pressing roller only along the movement of the fixing belt, V is the moving speed of the fixing belt, W is the width of the fixing belt perpendicular to the movement of the fixing belt in the surface area of the fixing belt sandwiched by the pressing roller and the supporting roller or the heating roller, and P is the load (pressure) applied to the area sandwiched by the pressing roller and the supporting roller or the heating roller.

In the fixing device controlling method of the present invention, the target heating roller temperature (a) that satisfies Expression (4) below is preferably calculated in step (iii).

$$A\times\text{target heating roller temperature }(a)+B\times\text{detected pressure roller temperature }(b)+C\times\text{loaded nipping time }(c)+D\times\text{false nipping time }(d)+E\times\text{loaded nipping surface pressure }(e)+F=0, \quad \text{Expression (4)}$$

wherein A, B, C, D, E, and F are all constants.

Further in the fixing device controlling method of the present invention, it is preferable to detect the ambient temperature and humidity and change the above constants in Expression (4) according to the result of detection.

In addition, it is preferable to actually measure the L1 value in Expressions (1) and (3) and the L2 value in Expression (3) and calculate the loaded nipping time (c), the false nipping time (d), and the loaded nipping surface pressure (e) from the result of actual measurement.

The fixing device of the invention comprising a heating roller containing a heat source, at least one supporting roller that is in parallel with the heating roller with a space between them, a fixing belt that is trained about the heating roller and the supporting roller, a pressing roller that is placed to form a nipping area between the fixing belt and the pressing roller and gives a pressing force to the heating roller or the supporting roller via the fixing belt, a temperature detecting means to detect the temperature of the pressing roller, and a control mechanism to control the operating status of the heating source in the heating roller, wherein said control mechanism sets the target heating roller temperature (a) from a detected temperature (b) of the pressing roller obtained by said temperature detecting means, a loaded nipping time (c) calculated by Expression (1), a false nipping time (d) calculated by Expression (2), and a loaded nipping surface pressure (e) calculated by Expression (3), and controls the operating status of the heat source in said heating roller according to the target heating roller temperature (a).

In the fixing device of the invention, said control mechanism is preferably a means to set a target heating roller temperature (a) by Expression (4).

Further, it is preferable that the fixing device is equipped with an operating environment detecting means to detect the ambient temperature and humidity and that said control mechanism has a function to change constants in Expression (4) according to the ambient temperature and humidity detected by said operating environment detecting means.

Furthermore, it is preferable that said control mechanism has a function to receive at least the L1 value for Expressions (1) and (3) and the L2 value for Expression (2) from the outside and calculate the loaded nipping time (c), the false nipping time (d), and the loaded nipping surface pressure (e) from the L1 and L2 values that are entered from the outside.

The image forming apparatus of the invention is characterized by being equipped with said fixing device.

In accordance with the above structures, the target heating roller temperature (a) is set optimum corresponding to the actually detected pressure roller temperature (b) considering the loaded nipping time (c), the false nipping time (d), and the loaded nipping surface pressure (e). Therefore, the subsequent fixing process can be executed with the temperature of the nipping area optimized.

Accordingly, even when the fixing process conditions such as the nipping width change as the time goes by, the target heating roller temperature (a) is set according to the quantity of variation. This enables the fixing device to keep the desired fixing performance steadily for a long time independently of the change in the fixing process condition and operating environment.

The above-described fourth through sixth objects can be accomplished by one of the structures below.

A method of controlling a fixing device comprising a heating roller containing a heat source, at least one supporting roller that is in parallel with the heating roller with a space between them, a fixing belt that is trained about the heating roller and the supporting roller, and a pressing roller that is placed to form a nipping area between the fixing belt and the pressing roller and gives a pressing force to the heating roller or the supporting roller via the fixing belt, wherein said method comprises the steps of presetting a desired glossiness of fixed images, detecting the temperature of said pressing roller, calculating the target heating roller temperature (a) from at least the preset glossiness of fixed images, the detected temperature (b) of the pressing roller, a loaded nipping time (c) calculated by Expression (1) below, a false nipping time (d) calculated by Expression (2) below, and a loaded nipping surface pressure (e) calculated by Expression (3) below, and controlling the operating status of the heat source in said heating roller according to the calculated target heating roller temperature (a).

$$\text{Loaded nipping time }(c)=L1/V \quad \text{Expression (1)}$$

$$\text{False nipping time }(d)=L2/V \quad \text{Expression (2)}$$

$$\text{Loaded nipping surface pressure }(e)=P/(L1\times W) \quad \text{Expression (3)}$$

In Expressions (1) to (3), L1 is the width of the fixing belt along the movement of the fixing belt in the surface area of the fixing belt sandwiched by the pressing roller and the supporting roller or the heating roller, L2 is the width of the fixing belt in the area in contact with the pressing roller only along the movement of the fixing belt, V is the moving speed of the fixing belt, W is the width of the fixing belt perpendicular to the movement of the fixing belt in the surface area of the fixing belt sandwiched by the pressing roller and the supporting roller or the heating roller, and P is the load (pressure) applied to the area sandwiched by the pressing roller and the supporting roller or the heating roller.

In the fixing device of the invention controlling method of the present invention, it is preferable to calculate the target heating roller temperature (a) that satisfies Expression (4') below.

$$ln[G/(100-G)]=A\times\text{target heating roller temperature }(a)+B\times\text{detected pressure roller temperature }(b)+C\times\text{loaded nipping time }(c)+D\times\text{false nipping time }(d)+E\times\text{loaded nipping surface pressure }(e)+F, \quad \text{Expression (4')}$$

wherein A, B, C, D, E, and F are all constants and G is the preset glossiness of fixed images.

Further in the fixing device controlling method of the present invention, it is preferable to detect the ambient temperature and humidity and change the above constants in Expression (4') according to the result of detection. Further, it is preferable to actually measure the L1 value in Expressions (1) and (3) and the L2 value in Expression (3) and calculate the loaded nipping time (c), the false nipping time (d), and the loaded nipping surface pressure (e) from the result of actual measurement.

A fixing device comprising a heating roller containing a heat source, at least one supporting roller that is in parallel with the heating roller with a space between them, a fixing belt that is trained about the heating roller and the supporting roller, a pressing roller that is placed to form a nipping area between the fixing belt and the pressing roller and gives a pressing force to the heating roller or the supporting roller via the fixing belt, a temperature detecting means to detect the temperature of the pressing roller, and a control mechanism to control the operating status of the heating source in the heating roller, wherein said control mechanism has a function for presetting the glossiness of fixed images to be formed, calculates the target heating roller temperature (a) at least from the preset fixed image glossiness, a detected temperature (b) of the pressing roller obtained by said temperature detecting means, a loaded nipping time (c) calculated by Expression (1), a false nipping time (d) calculated by Expression (2), and a loaded nipping surface pressure (e) calculated by Expression (3), and controls the operating status of the heat source in said heating roller according to the target heating roller temperature (a).

In the fixing device of the invention, said control mechanism is preferably a means to calculate the target heating roller temperature (a) by Expression (4').

Further, it is preferable that the fixing device is equipped with an operating environment detecting means to detect the ambient temperature and humidity and that said control mechanism has a function to change constants in Expression (4') according to the ambient temperature and humidity detected by said operating environment detecting means.

Furthermore, it is preferable that said control mechanism has a function to receive at least the L1 value for Expressions (1) and (3) and the L2 value for Expression (2) from the outside and calculate the loaded nipping time (c), the false nipping time (d), and the loaded nipping surface pressure (e) from the L1 and L2 values that are entered from the outside.

The image forming apparatus of the invention is characterized by being equipped with said fixing device.

In accordance with the above structures, as the fixing device is controlled according to a preset glossiness of fixed images considering factors that greatly affect the glossiness of fixed images, such as the heating roller temperature, the pressing roller temperature, the loaded nipping time (c), the false nipping time (d), and the loaded nipping surface pressure (e) that are calculated by Expressions (1) through (3), the fixing device can easily form fixed images of desired glossiness. Further, the fixing device calculates the target heating roller temperature (a) from the actually-detected pressing roller temperature (b) and controls the operating status of the heat source in the heating roller by the temperature (a) to keep the nipping area at an optimum temperature. With this, the fixing device can steadily form fixed images of desired glossiness.

When the fixing process condition such as a nipping width varies as the time goes by, the target heating roller temperature (a) is set according to the quantity of variation. With this, the fixing device can steadily form fixed images of desired glossiness for a long time.

DETAILED DESCRIPTION OF THE PREFERRED EMBODIMENTS

Further objects and advantages of the invention will appear from the following description, taken together with the accompanying drawings.

<Embodiment 1>

Figure 1:
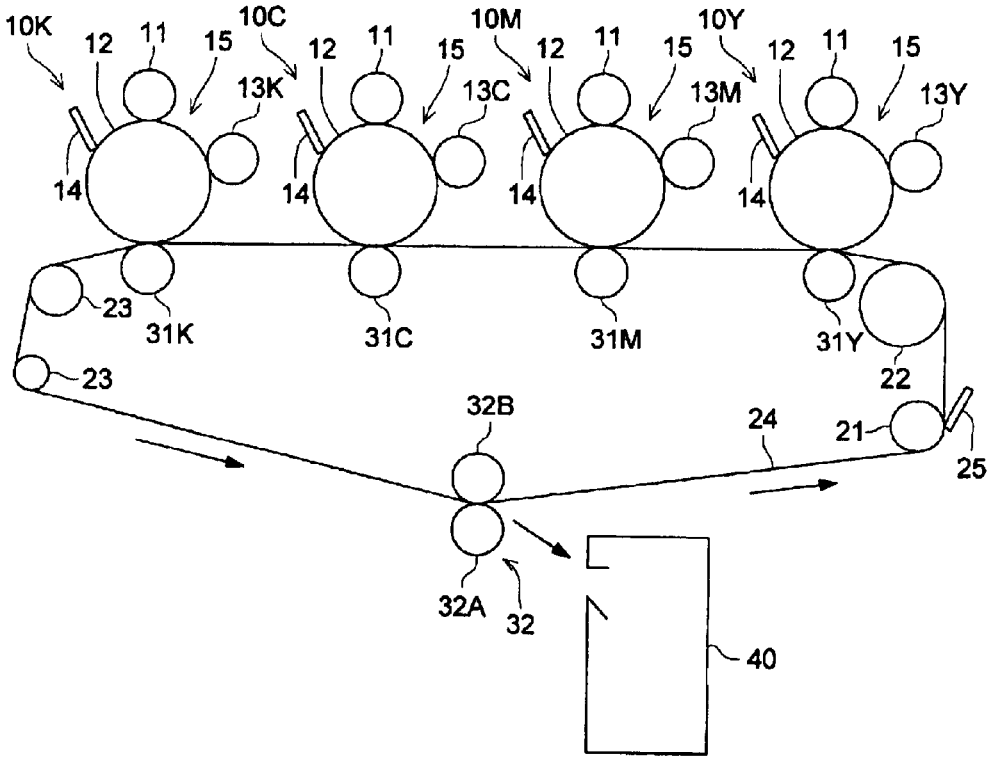
FIG. 1 is a simplified cross-sectional view of an image forming apparatus which is the first embodiment of the present invention.
Figure 2:
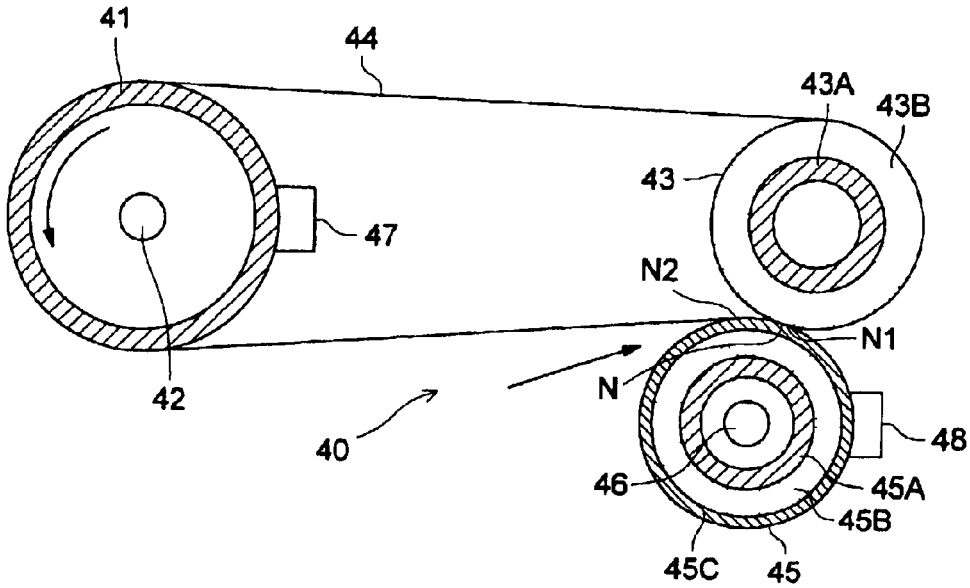
FIG. 2 is a simplified cross-sectional view of a fixing device in an image forming apparatus of FIG. 1.

FIG. 1 is a simplified cross-sectional view of a color image forming apparatus which is the first embodiment of the present invention. FIG. 2 is a simplified cross-sectional view of a fixing device in a color image forming apparatus of FIG. 1.

This color image forming apparatus contains four toner image forming units 10Y (yellow toner), 10M (magenta toner), 10C (cyan toner), and 10K (black toner) in that order.

Each of the toner image forming unit 10Y, 10M, 10C, and 10K comprises an image carrier 12 made of a rotary drum-shaped photosensitive unit, a charging roller unit 11 to apply charges to the outer surface of the image carrier 12 along the rotating direction of the image carrier 12, an exposing means 15 which scans a laser beam over the surface of the image carrier 12 according to image information to form static images on the surface of the image carrier 12, a developer (13Y, 13M, 13C, and 13K in that order) to develop a static image into a toner image with a corresponding toner (yellow, magenta, cyan, and black), and a cleaning blade 14 to remove toner left remained on the surface of the image carrier 12 after each primary transfer mechanism (31Y, 31M, 31C, and 31K to be explained later).

The color image forming apparatus is equipped with a belt-like endless intermediate transfer means 24 which is driven to move endlessly by a set of rollers including a driving roller 21, a tension roller 22, and two or more supporting rollers 23 to connect the toner image forming units 10Y, 10M, 10C, and 10K. Transferring rollers are respectively provided in the downstream side of the developers 13Y, 13M, 13C, and 13K of the image carriers 12 to press the intermediate transfer means 24 against the corresponding image carriers 12. These constitute the primary transfer mechanisms 31Y, 31M, 31C, and 31K.

Each of the primary transfer mechanisms 31Y, 31M, 31C, and 31K applies proper transfer potentials to the corresponding transfer roller. This potential electro-statically attracts an original toner image which is formed on each image carrier 12 by the corresponding developer 13Y, 13M, 13C, or 13K in the corresponding toner image forming unit 10Y, 10M, 10C, or 10K, transfers the image to the intermediate transfer unit 24, and firmly fixes it to the surface of the intermediate transfer unit 24. In this manner, the primary transfer of the original toner image is performed.

A secondary transfer roller 32A and a backup roller 32B are provided in part of the moving path of the intermediate transfer unit 24 to pincer-press the intermediate transfer belt 24. This constitutes a secondary transfer mechanism 32 that transfers a toner image from the intermediate transfer belt 24 onto a recording medium (not visible in FIG. 1) which is supplied in synchronism by a proper transfer potential applied to the secondary transfer roller 32A. This secondary transfer mechanism 32 employs the same transfer principle as said primary transfer mechanism 31 to form secondary transfer toner images onto the recording media. A blade 25 for cleaning the intermediate transfer unit is provided in the downstream side of the driving roller 21.

In the above description, it is possible to run any one or all of the four toner image forming units 10Y, 10M, 10C, and 10K. When all toner image forming units are in operation, original toner images on the image carriers 12 are transferred in sequence onto the intermediate transfer unit 24 to form a full color toner image.

A fixing device 40 is provided in the downstream side off the secondary transfer mechanism 32. As shown in FIG. 2, the fixing device 40 comprises a heating roller 41 containing a halogen heater lamp 42 as a heat source, a supporting roller 43 that is in parallel with the heating roller with a space between the rollers 41 and 43, an endless fixing belt 44 that is trained about the heating roller 41 and the supporting roller 43, and a pressing roller 45 containing a halogen heater lamp 46 as a heat source which is placed to form a nipping area N between the fixing belt 44 and the pressing roller 45 and gives a pressing force to the supporting roller 43 via the fixing belt 44. The nipping area N contains a loaded nipping area N1 at which the fixing belt 44 is pincer-pressed by the supporting roller 43 and the pressing roller 45 and a false nipping area N2 at which the fixing belt 44 is in contact with the pressing roller 45 only. In this example, the false nipping area N2 is in the upstream side of the loaded nipping area N1.

Further the fixing device 40 contains a means 47 for detecting the temperature of the heating roller in contact with or very closely to the surface of the heating roller 41 and another means 48 for detecting the temperature of the pressing roller 45 in contact with or very closely to the surface of the pressing roller 45.

Further, the fixing device 40 contains a means (not visible in FIG. 2) for varying the load on the loaded nipping area N1 and for example a means (not visible in FIG. 2) for varying the longitudinal width of the fixing belt 44 in the false nipping area N2.

Furthermore, the fixing device 40 has a mechanism (not visible in FIG. 2) for controlling the on/off status of the halogen heater lamp 42 in the heating roller 41 and the halogen heater lamp 46 in the pressing roller 45.

The heating roller 41 is made of a metallic cylinder extending across the moving path of the recording materials to be supplied.

The outer diameter of the heating roller 41 is for example 30 to 80 mm and preferably 40 to 50 mm. The thickness of the cylinder wall forming the heating roller 41 is for example 1 to 5 mm and preferably 2 to 3 mm.

The metallic cylinder of the heating roller 41 can be made of any metal. For example, the metal is substantially selected from a group of aluminum, iron, copper, and their alloys.

The supporting roller 43 comprises a metallic core bar 43A and an elastic layer 43B that covers the surface of the core bar 43A.

The metallic core bar 43A can be made of any metal. For example, the metal is substantially selected from a group of iron, aluminum, copper, and their alloys.

The elastic material constituting the elastic layer 43B can be any soft rubber or sponge rubber such as urethane rubber and silicone rubber.

The thickness of the elastic layer 43B is for example 1 to 10 mm and preferably 1 to 5 mm.

The fixing belt 44 preferably comprises an endless belt base, an elastic layer covering the belt base, and a coating layer over the elastic layer.

The materials for the belt base can be any selected from metal materials such as nickel and resin materials such as polyimide resin. The thickness of the belt base is for example 40 to 60 $\mu$m (when a metallic material is used) or 50 to 90 $\mu$m (when a resin material is used).

The material of the elastic layer on the fixing belt 44 can be for example a silicone rubber and the thickness of the elastic layer is for example 150 to 250 $\mu$m.

The material constituting the coating layer of the fixing belt can be for example a fluorocarbon resin such as polytetrafluoroethylene (PTFE) and tetrafluoroethylene-perfluoroalkylvinylether copolymer (PFA) and the thickness of the coating layer is for example 30 to 50 $\mu$m.

The pressing roller 45 comprises a metallic core bar 45A, an elastic layer that covers the surface of the core bar 45B, and a coating layer 45C covering the surface of the elastic layer 45B.

The metallic core bar 45A can be made of any metal. For example, the metal is substantially selected from a group of iron, aluminum, copper, and their alloys.

The elastic material constituting the elastic layer 45B can be any soft rubber or sponge rubber such as urethane rubber and silicone rubber.

The thickness of the elastic layer 45B is for example 1 to 10 mm and preferably 2 to 5 mm.

The material constituting the coating layer 45C is made of for example a fluorocarbon resin such as polytetrafluoroethylene (PTFE) and tetrafluoroethylene-perfluoroalkylvinylether copolymer (PFA).

The ASKER C hardness (measured at a load of 500 grams) of the pressing roller 45 is 35 to 70° and preferably 40 to 55°.

The control mechanism has a function of setting a target heating roller temperature (a) from a detected temperature (b) of the pressing roller obtained by the temperature detecting means 48, a loaded nipping time (c) calculated by Expression (1), a false nipping time (d) calculated by Expression (2), and a loaded nipping surface pressure (e) calculated by Expression (3). Substantially, the target heating roller temperature (a) is calculated by the expressions below.

$$\text{Loaded nipping time } (c) = L1/V \qquad \text{Expression (1)}$$

$$\text{False nipping time } (d) = L2/V \qquad \text{Expression (2)}$$

$$\text{Loaded nipping surface pressure } (e) = P/(L1 \times W) \qquad \text{Expression (3)}$$

$$A \times \text{target heating roller temperature } (a) + B \times \text{detected pressure roller temperature } (b) + C \times \text{loaded nipping time } (c) + D \times \text{false nipping time } (d) + E \times \text{loaded nipping surface pressure } (e) + F = 0 \qquad \text{Expression (4)}$$

In Expressions (1) to (3), L1 is the width of the fixing belt along the movement of the fixing belt 44 in the surface area (or the loaded nipping area N1) of the fixing belt 44 sandwiched by the pressing roller 45 and the supporting roller 43, L2 is the width of the fixing belt in the area (or the false nipping area N2) in contact with the pressing roller 45 only along the movement of the fixing belt. V is the moving speed of the fixing belt, W is the width of the fixing belt 44 perpendicular to the movement of the fixing belt 44 in the loaded nipping area N1, and P is the load (or the nipping load) applied to the area of the fixing belt 44 sandwiched by the pressing roller 45 and the supporting roller 43.

In above Expression (4), A, B, C, D, E, and F are all constants and set as explained below.

Constants A, B, C, D, E, and F are calculated by the steps of fixing unfixed toner images on a plurality of recording materials while varying the heating roller temperature, the pressing roller temperature, the loaded nipping time, the false nipping time, and the loaded nipping surface pressure, forming solid images on the recording materials, measuring the glossiness of the fixed solid images, performing the multi-regression analysis using the above fixing process condition data (heating roller temperature, pressing roller temperature, loaded nipping time, false nipping time, and loaded nipping surface pressure) as the explanatory variables and glossiness data of the fixed images as the object variable, and setting the required glossiness of fixed images as a reference glossiness. The "glossiness" here is defined as a 75-degree specular glossiness $G_s$ (75°) in JIS Z8741 and can be measured for example by a glossmeter "VGS-1D" fabricated by Nippon Denshoku Co., Ltd.

Such a control mechanism controls the thermal status of the heating roller 41 as explained below.

When the image forming apparatus is turned on, the heater lamp power-on control mechanism (not visible in the drawing) controls to turn on the halogen heater lamp 42 in the heating roller 41 and the halogen heater lamp 46 in the pressing roller 45 and warm up the heating roller 41 and the pressing roller 45 until they reach the preset temperatures. The preset temperature of the heating roller 41 unlike the target heating roller temperature (a) for actual fixing is a temperature at which fixing is executable.

When the heating roller 41 and the pressing roller 45 reach the preset temperatures, the control mechanism calculates the target heating roller temperature (a) from Expression (4) and controls the on status of the halogen heater lamp 42 in the heating roller 41 by this target heating roller temperature (a) and the halogen heater lamp 46 in the pressing roller 45 by the preset temperature.

In more detail, constants A, B, C, D, E, and F are entered into the control unit according to the kind of recording material in use, the operating environment, and so on together with a loaded nipping time (c), a false nipping time (d), and a loaded nipping surface pressure (e).

Figure 3:
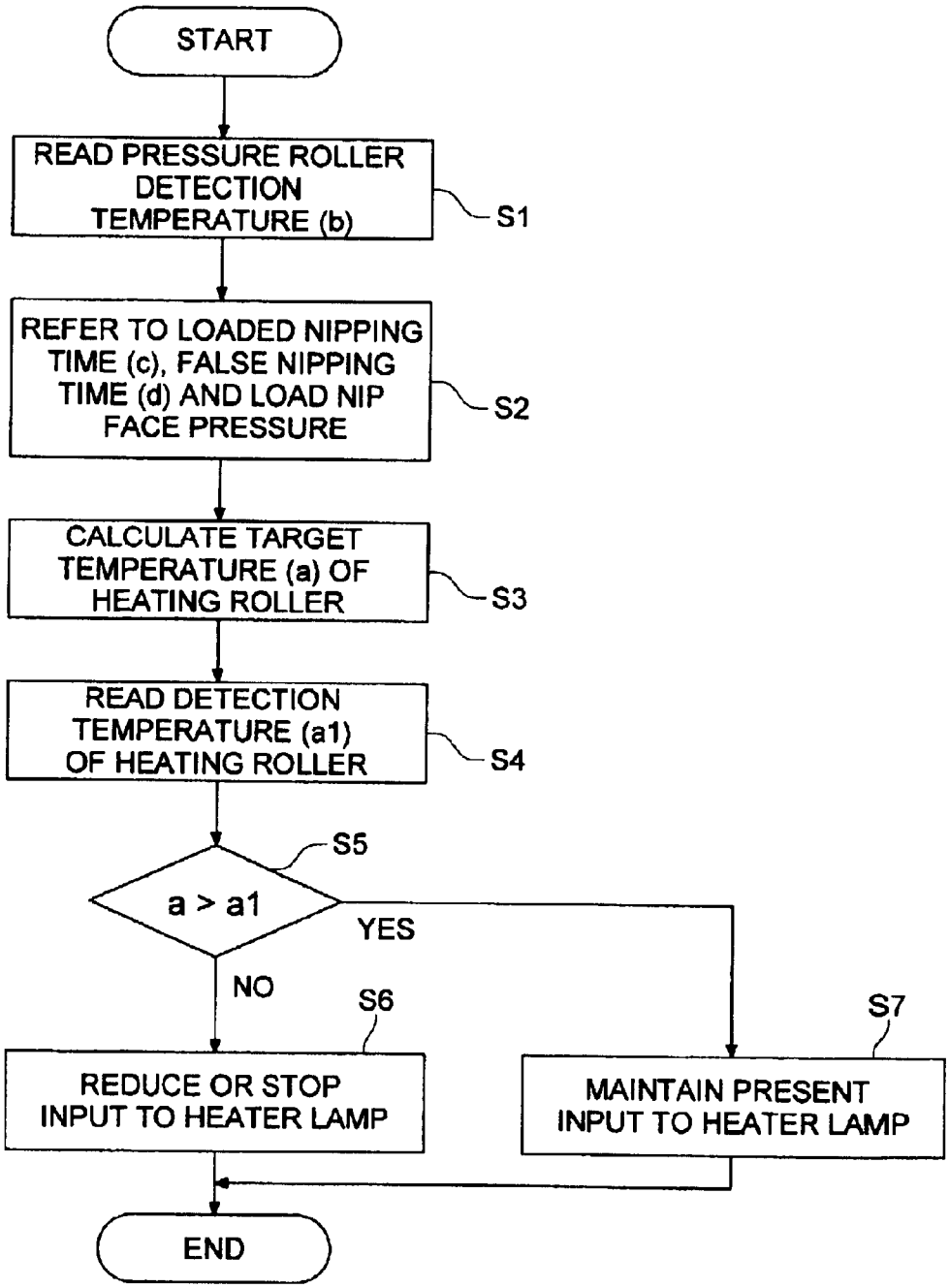
FIG. 3 shows a flow chart of a control method which is an embodiment of the present invention.

Referring to FIG. 3, the pressing roller temperature detecting means 48 starts to detect the surface temperature of the pressing roller 45 and the detected pressing roller temperature (b) is read by the control mechanism (in Step S1). Also in this step (S1), the heating roller temperature detecting means 47 detects the surface temperature of the heating roller 41 in synchronism with the detection of the temperature of the pressing roller 45.

In Step S3, the target heating roller temperature (a) is calculated by Expression (4) using the loaded nipping time (c), the false nipping time (d), and the loaded nipping surface pressure (e) that have been entered together with the constants A, B, C, D, E, and F.

Then, the control mechanism reads the detected heating roller temperature (a1) from the heating roller temperature detecting means 47 (Step S4) and compares the temperature (a1) with the target heating roller temperature (a) in the decision block (in Step S5). When the detected temperature (a1) is higher than the target temperature (a), the control mechanism reduces or stops power to the halogen heater lamp 42. In the other case, the control mechanism keeps on lighting the halogen heater lamp 42 (Step S7).

Similarly, the pressing roller temperature (b) detected by the pressing roller temperature detecting means 48 is compared with the preset temperature of the pressing roller 45. When the detected pressing roller temperature (b) is higher than the preset pressing roller temperature, the control mechanism reduces or stops power to the halogen heater lamp 46. In the other case, the control mechanism keeps on lighting the halogen heater lamp 46.

These steps are repeated to control the on-status of the halogen heater lamps 42 and 46 so that the nipping area N may be kept at an optimum temperature according to the kind of recording material and the operating condition.

Experimentally, preferable fixing process conditions are Loaded nipping width (L1: longitudinal width of the fixing belt 44 in the loaded nipping area N1) of 5 to 12 mm, False nipping width (L1: longitudinal width of the fixing belt 44 in the false nipping area N2) of 0 to 15 mm, moving speed of the fixing belt 44 of 180 to 250 mm/sec, loaded nipping time of 20 to 67 m·sec, false nipping time of 0 to 84 m·sec, nipping load P of 400 to 800 N, loaded nipping area N1 of 17 to 41 $cm^2$, loaded nipping surface pressure of 98 to 470 KPa, preset temperature of the heating roller 41 of 180 to 230° C., and Preset temperature of the pressing roller 45 of 120 to 170° C.

Under the above fixing process condition, the nipping area N is controlled at a temperature optimum for fixing.

In accordance with the above image forming apparatus, the target heating roller temperature (a) of the fixing device 40 is set to an optimum temperature value corresponding to the actually-detected pressing roller temperature (b) considering to the fixing process condition including the fixing nipping time (c) and the fixing nipping surface pressure (d), that is, to a target heating roller temperature (a) obtained by correcting the fluctuation which was made due to the kind of recording material in use, setting of image formation, or change in the operating environment. Therefore, the subsequent fixing processes can be carried out with the fixing nipping area N controlled at the optimum temperature and images of always-stable fixing performance can be obtained. As the result, the image forming apparatus can steadily form images of uniform glossiness.

Further, as the target heating roller temperature (a) is set according to the detected pressing roller temperature (b), the target heating roller temperature (a) can be set correctly even when the change in temperature of the pressing roller 45 is very small.

In accordance with the present invention, the control mechanism is equipped with a function to enter the L1 value for Expressions (1) and (3) and the L2 value for Expression (2) from the outside and a function to calculate the loaded nipping time (c), the false nipping time (d), and the loaded nipping surface pressure (e) from the L1 and L2 values that are entered from the outside. The L1 value (the loaded nipping width) for Expressions (1) and (3) and the L2 value (the false nipping width) for Expression (2) are actually measured every predetermined number of fixings. The control mechanism calculates the loaded nipping time (c), the false nipping time (d), and the loaded nipping surface pressure (e) by Expressions (1) to (3) and the measured L1 and L2 values, and can set the target heating roller temperature (a) by Expression (4) and the result of calculation (the loaded nipping time (c), the false nipping time (d), and the loaded nipping surface pressure (e).

Figure 4:
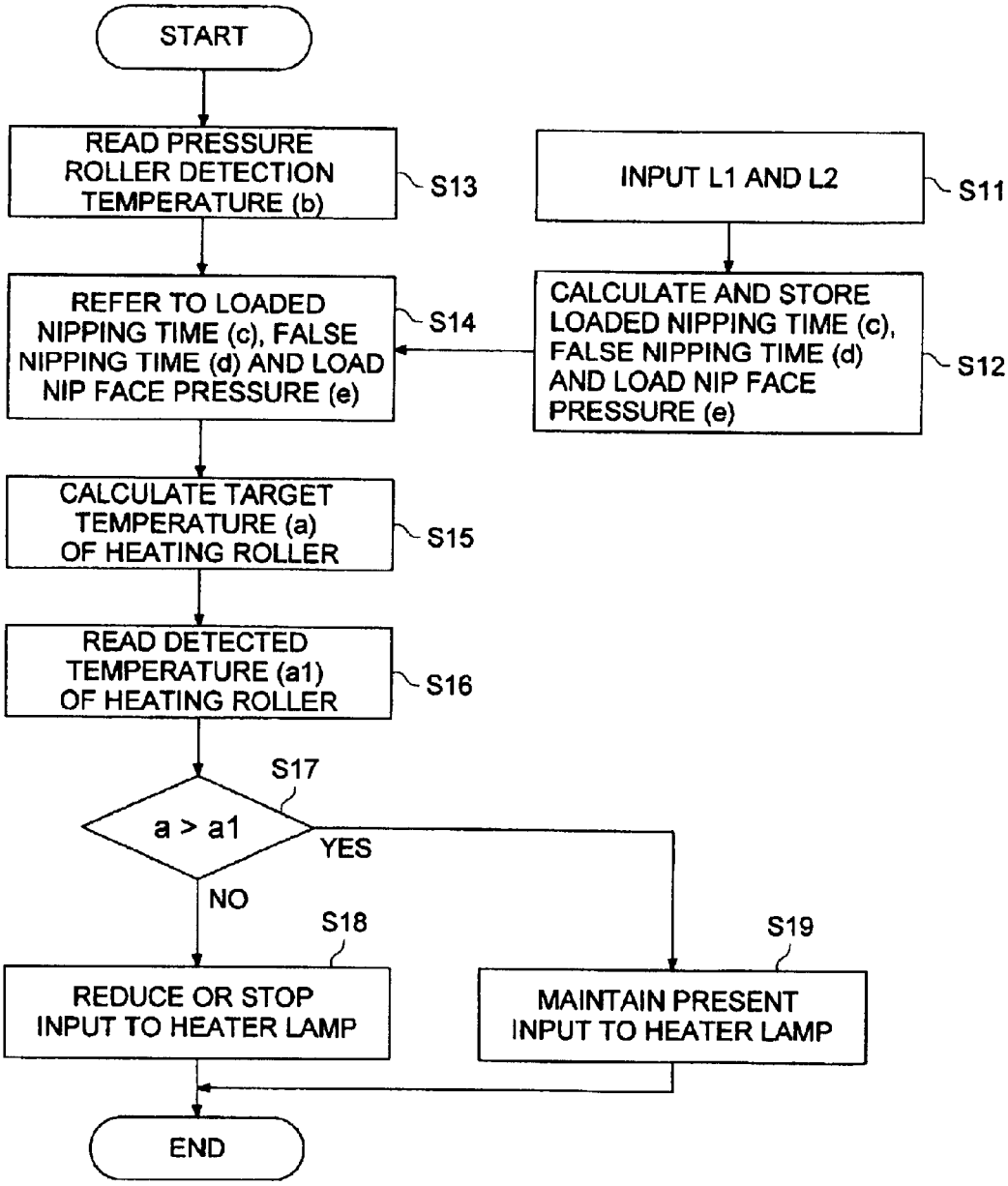
FIG. 4 shows a flow chart of a control method which is another embodiment of the present invention.

As shown in FIG. 4, more detailed steps comprise actually measuring L1 values (loaded nipping widths) and L2 values (false nipping widths), entering the actually-measured L1 and L2 values into the control mechanism along with a series of commands for starting the image formation (Step S1), calculating the loaded nipping time (c), the false nipping time (d), and the loaded nipping surface pressure (e) by Expressions (1) to (3) in the arithmetic block of the control mechanism, storing the result in the recording block (Step S12), sending the detected pressing roller temperature (b) (detected by the pressing roller temperature detecting means 48) to the control mechanism (Step S13), referring to the loaded nipping time (c), the false nipping time (d), and the loaded nipping surface pressure (e) which are actually measured (Step 14), and calculating the target heating roller temperature (a) by Expression (4) (Step S15). These steps are followed by steps S16 to S19 as those in FIG. 3.

In the above, the L1 value (the loaded nipping width) and the L2 value (the false nipping width) can be measured for example as explained below.

The measurement comprises the steps of preparing a recording material having a solid black toner image on the whole material, supplying this recording material to the fixing device that has been warmed up, stopping movement of the fixing belt when the solid fixed image on the recording material is in contact with the fixing belt in the whole loaded and false nipping areas, and keeping this status for 10 to 15 seconds, ejecting the recording material as a jam out of the fixing device. The solid fixed image on the recording material has different glossiness in the area in contact with the fixing belt in the loaded nipping area, in the area in contact with the fixing belt in the false nipping area, and in the other area. So these areas can be identified. The L1 and L2 values can be obtained by measuring the width (L1) of the loaded nipping area in contact with the fixing belt and the width (L2) of the false nipping area in contact with the fixing belt. The L1 and L2 values can be easily measured when a program of the above operation is stored in the control block of the image forming apparatus.

In accordance with the above control method, the fixing process can be carried out with the temperature of the nipping block controlled at an optimum temperature fit for the actual fixing operation even when the fixing process condition such as the loaded and false nipping widths vary as the time goes by because the target heating roller temperature (a) is set according to the loaded nipping time (c), the false nipping time (d), and the loaded nipping surface pressure (e) which are actually measured.

Further in the present invention, the constants A to F in Expression (4) are changed according to the ambient temperature and humidity and the target heating roller temperature (a) can be set using the new constants A to F in Expression (4). Substantially, the control method of the present invention takes the steps of changing the operating environment (ambient temperature and humidity) in preset temperature and humidity ranges, calculating values of constants A to F in Expression (4) in respective operating environments, storing each set of constants A to F in the memory block of the control mechanism, detecting the ambient temperature and humidity by the operating environment detecting means, selecting the related operating environment constants from those stored in the memory block according to the detected temperature and humidity, changing thereof, and calculating the target heating roller temperature (a) by Expression (4) using the new constants.

In accordance with the above control method, the fixing process can be carried out with the temperature of the nipping block N controlled at an optimum temperature fit for the actual fixing operation even when the environmental condition varies because values of constants in Expression (4) vary according to the actual operating environment. Therefore, the fixing performance that is always stable for a long time can be obtained independently of the operating environment.

Although the method of controlling the fixing device in the above image forming apparatus contains a step of calculating the target heating roller temperature (a) by Expression (4), it is possible to substitute this step by a step comprising calculating respective target heating roller temperatures (a) corresponding to the detected pressing roller temperatures (b) by Expression (4), storing thereof, and selecting a target heating roller temperature (a) directly from the detected pressing roller temperature information (obtained by the pressing roller temperature detecting means 48).

This process omits a step of calculating the target heating roller temperature (a) by Expression (4) and simplifies the setting of the target heating roller temperature (a). Therefore, this method can control the temperature of the heating roller 41 very easily. Further, as the selected target heating roller temperature (a) is calculated in advance by Expression (4), the temperature of the heating roller 41 can be controlled with a high reliability.

<Embodiment 2>

Figure 5:
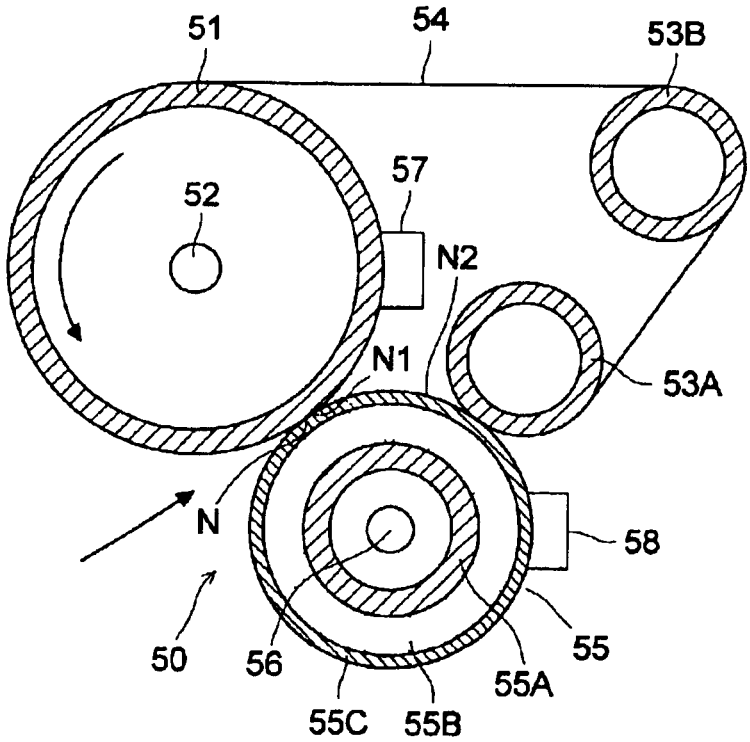
FIG. 5 is a simplified cross-sectional view of a fixing device in an image forming apparatus which is the second embodiment of the present invention.

FIG. 5 is a simplified cross-sectional view of a fixing device in an image forming apparatus which is the second embodiment of the present invention. The configuration of this image forming apparatus is the same as that of the image forming apparatus of Embodiment 1 except the fixing device.

The fixing device 50 comprises a heating roller 51 containing a halogen heater lamp 52 as a heat source, a supporting roller 53A that is in parallel with the heating roller 51 with a space between the rollers 51 and 53A, a supporting roller 53B that is in parallel with the rollers 51 and 53A with a space therebetween, an endless fixing belt 54 that is trained about the heating roller 51 and the supporting rollers 53A and 53B, and a pressing roller 55 containing a halogen heater lamp 56 as a heat source which is placed to form a nipping area N between the fixing belt 54 and the pressing roller 55 by pressing the heating roller 51 via the fixing belt 54. The nipping area N contains a loaded nipping area N1 at which the fixing belt 54 is pincer-pressed by the heating roller 51 and the pressing roller 55 and a false nipping area N2 at which the fixing belt 54 is in contact with the pressing roller 55 only. In this example, the false nipping area N2 is in the downstream side of the loaded nipping area N1. The first supporting roller 53A has a function (as a separation roller) to separate the fixing belt 54 from the pressing roller 55 and a function (as a tension roller) to give a specified tension to the fixing belt 54. These functions can control the false nipping width and the tension of the fixing belt by moving the first supporting roller 53A.

Further the fixing device 50 contains a means 57 for detecting the temperature of the heating roller 51 in contact with or very closely to the surface of the heating roller 51 and another means 58 for detecting the temperature of the pressing roller 55 in contact with or very closely to the surface of the pressing roller 55.

The fixing device 50 is equipped with a means (not visible in FIG. 5) for changing the load upon the loaded nipping area N1 and another means (not visible in FIG. 5) for changing the false nipping width by moving the first supporting roller 53A.

Further, the fixing device 50 has a control mechanism (not visible in FIG. 5) to control the power-on status of the halogen heater lamp 52 in the heating roller 51 and the halogen heater lamp 56 in the pressing roller 55.

Each of the first and second supporting rollers 53A and 53B comprises a metallic cylinder which extends across the recording material.

The metallic cylinders constituting the supporting rollers 53A and 53B can be made of any metal. Substantially, the metal can be selected for example from a group of aluminum, iron, copper, and their alloys.

The configuration of the heating roller 51, the fixing belt 54, and the pressing roller 55 of this embodiment is the same as those (the heating roller 41, the fixing belt 44, and the pressing roller 45) of Embodiment 1.

The control mechanism has a function to set a target heating roller temperature (a) from a detected temperature (b) of the pressing roller obtained by said temperature detecting means 58, a loaded nipping time (c) calculated by Expression (1), a false nipping time (d) calculated by Expression (2), and a loaded nipping surface pressure (e) calculated by Expression (3), and substantially controls the target heating roller temperature (a) by Expression (4).

Loaded nipping time $(c)=L1/V$ Expression (1)

False nipping time $(d)=L2/V$ Expression (2)

Loaded nipping surface pressure $(e)=P/(L1\times W)$ Expression (3)

$A\times$target heating roller temperature $(a)+B\times$detected pressure roller temperature $(b)+C\times$loaded nipping time $(c)+D\times$false nipping time $(d)+E\times$loaded nipping surface pressure $(e)+F=0$ Expression (4)

In Expressions (1) to (3), L1 is the width of the fixing belt 54 along the movement of the fixing belt 54 in the surface area (or the loaded nipping area N1) of the fixing belt sandwiched by the heating roller 51 and the pressing roller 55, L2 is the width of the fixing belt in the area (or the false nipping area N2) in contact with the pressing roller 55 only along the movement of the fixing belt 54, V is the moving speed of the fixing belt, W is the width of the fixing belt 54 perpendicular to the movement of the fixing belt 54 in the loaded nipping area N1, and P is the load (or the nipping load) applied to the area of the fixing belt 54 sandwiched by the heating roller 51 and the pressing roller 55.

In the above Expression (4), constants A, B, C, D, E, and F are all set in the same manner as in Embodiment 1.

This control mechanism controls the thermal status of the heating roller 51 in the same manner as in Embodiment 1.

In accordance with the above image forming apparatus, the target heating roller temperature (a) of the fixing device 50 is set to an optimum temperature value corresponding to the actually-detected pressing roller temperature (b) considering to the fixing process condition including the fixing nipping time (c) and the fixing nipping surface pressure (d), that is, to a target heating roller temperature obtained by correcting the fluctuation which was made due to the kind of recording material in use, setting of image formation, or change in the operating environment. Therefore, the subsequent fixing processes can be carried out with the fixing nipping area N controlled at the optimum temperature and images of always-stable fixing performance can be obtained.

Further, as the target heating roller temperature (a) is set according to the detected pressing roller temperature (b), the target heating roller temperature (a) can be set correctly even when the change in temperature of the pressing roller 55 is very small.

The above control mechanism actually measures the L1 (loaded nipping width) value for Expressions (1) and (3) and the L2 (false nipping width) value for Expression (2) every predetermined number of fixings, calculates the loaded nipping time (c), the false nipping time (d), and the loaded nipping surface pressure (e) by Expressions (1) to (3) and the measured L1 and L2 values, and can set the target heating roller temperature (a) by Expression (4) and the result of calculation (the loaded nipping time (c), the false nipping time (d), and the loaded nipping surface pressure (e).

Further, the control mechanism changes the constant values A to F in Expression (4) according to the ambient temperature and humidity and sets the target heating roller temperature (a) by Expression (4) using the new constant values.

It is possible to substitute the above calculation step to calculate the target heating roller temperature (a) by Expression (4) by a step comprising calculating respective target heating roller temperatures (a) corresponding to the detected pressing roller temperatures (b) in advance by Expression (4), storing thereof, and selecting a target heating roller temperature (a) directly from the detected pressing roller temperature information (obtained by the pressing roller temperature detecting means 58).

EXAMPLES

Below will be explained some examples of the present invention. It is to be expressly understood, however, that these examples are for the purpose of explanation only and are not intended as a definition of the limits of the invention.

Example 1

A fixing device (40) was prepared using components listed below according to the configuration shown in FIG. 2 and further prepared an image forming apparatus using this fixing device as shown in FIG. 1.

Heating roller (41): An aluminum cylinder (50 mm in outer diameter, 2 mm in wall thickness, and 340 mm in full width) containing a halogen heater lamp (42) therein, Supporting roller (43): An iron (STKM) cylinder (21 mm in outer diameter, 3 mm in wall thickness, and 340 mm in full width) as a core bar (43A) coated with a silicone rubber layer (43B) of 2 mm thick (The outer diameter of the supporting roller is 25 mm.), Fixing belt (44): An endless nickel belt base (330 mm in width, 70 mm in full circumferential length, and 40 $\mu$m in thickness) having a silicone rubber layer (150 $\mu$m thick) and a coating layer (30 $\mu$m thick) made of tetrafluoroethylene-perfluoroalkylvinylether copolymer (PFA) on the surface, Pressing roller (45): An aluminum cylinder (46 mm in outer diameter, 2 mm in wall thickness, and 340 mm in full width) as a core bar (45A) containing a halogen heater lamp (42) therein and coated with a silicone rubber layer (45B) of 2 mm thick and a coating layer (45C) made of tetrafluoroethylene-perfluoroalkylvinylether copolymer (PFA) on the surface (The outer diameter of the supporting roller is 50 mm. The ASKER C hardness at a load of 500 grams of the pressing roller is 50°).

A trial was made to form a 40 mm×40 mm rectangular solid image (with styrene acryl polymer toner of 1.0 mg/cm$^2$) on each piece of A4-size coated paper at a temperature of 20° C. and a relative humidity of 50% by changing the heating roller temperature, the pressing roller temperature, the loaded nipping time, the false nipping time, and the loaded nipping surface pressure and to measure the glossiness (75-degree specular glossiness $G_s$ (75°)) of each solid image by the glossmeter "VGS-1D" fabricated by Nippon Denshoku Co., Ltd.

Next the multi-regression analysis was performed using the above fixing condition data (heating roller temperature, pressing roller temperature, loaded nipping time, false nipping time, and loaded nipping surface pressure) as the explanatory variables and glossiness data of the fixed images as the object variable, a reference glossiness of 20° was set, and calculation was made of the values of constants A, B, C, D, E, and F in Expression (4). The resulting constant values were A=0.02471, B=0.01121, C=0.2444, D=0.02501, E=0.0202, and F=−11.1.

A total of one thousand fixing tests was made, each of which formed a 40 mm×40 mm rectangular solid image (with styrene acryl polymer toner of 1.0 mg/cm$^2$) on each piece of A4-size coated paper at a temperature of 20° C. and a relative humidity of 50% under conditions of the initial preset temperature of the heating roller (41) of 205° C., the preset temperature of the pressing roller (45) of 150° C., the loaded nipping width (L1) of 5.8 mm, the false nipping width (L2) of 11 mm, the moving speed (V) of the fixing belt (44) of 220 mm/sec, the loaded nipping area (L1×W) of 19.7 Cm$^2$, the nipping load (P) of 460N, the loaded nipping time (c) of 27 m·sec, the false nipping time (d) of 50 m·sec, and the loaded nipping surface pressure (e) of 234 KPa. During the above fixing tests, we calculated the target heating roller temperature (a) by Expression (4) from the pressing roller temperature detected by the pressing roller temperature detecting means and controlled the power-on status of the halogen heater lamp (42) of the heating roller (41) according to the calculated target heating roller temperature (a).

Every ten fixings, measurement was made of the glossiness (75-degree specular glossiness $G_s$ (75°)) of the fixed image by the glossmeter "VGS-1D" fabricated by Nippon Denshoku Co., Ltd. The obtained glossiness of each test sample is the reference glossiness±2° or less. This means that the expected fixing performance is obtained steadily.

Example 2

The same test was made as Example 1 except the following: the initial preset temperature of the heating roller (41) of 200° C., the preset temperature of the pressing roller (45) of 150° C., the loaded nipping time (c) of 30 m·sec, the false nipping time (d) of 55 m·sec, and the loaded nipping surface pressure (e) of 220 KPa.

The obtained glossiness (75-degree specular glossiness $G_s$ (75°)) of each test sample is the reference glossiness±2° or less. This means that the expected fixing performance is obtained steadily even when the fixing condition is changed.

Example 3

A fixing device (50) was prepared using components listed below according to the configuration shown in FIG. 5, further an image forming apparatus was prepared using this fixing device in the same manner as in Example 1, Heating roller (51): An iron (STKM) cylinder (50 mm in outer diameter, 3 mm in wall thickness, and 340 mm in full width) containing a halogen heater lamp (52) therein, First supporting roller (53A): An iron (STKM) cylinder (20 mm in outer diameter, 2 mm in wall thickness, and 340 mm in full width), Second supporting roller (53B): An iron (STKM) cylinder (20 mm in outer diameter, 2 mm in wall thickness, and 340 mm in full width), Fixing belt (54): An endless polyimide belt base (330 mm in width, 70 mm in full circumferential length, and 70 μm in thickness) having a silicone rubber layer (150 μm thick) and a coating layer (30 μm thick) made of polytetrafluoroethylene (PTFE) on the surface, Pressing roller (55): An aluminum cylinder (64 mm in outer diameter, 3 mm in wall thickness, and 340 mm in full width) as a core bar (55A) coated with a silicone rubber layer (55*b*) of 3 mm thick and a coating layer (55C) made of tetrafluoroethylene-perfluoroalkylvinylether copolymer (PFA) on the surface (The outer diameter of the supporting roller is 50 mm. The ASKER C hardness at a load of 500 grams of the pressing roller is 40°).

A trial was made to form a 40 mm×40 mm rectangular solid image (with styrene acryl polymer toner of 1.0 mg/cm$^2$) on each piece of A4-size coated paper at a temperature of 20° C. and a relative humidity of 50% by changing the heating roller temperature, the pressing roller temperature, the loaded nipping time, the false nipping time, and the loaded nipping surface pressure and to measure the glossiness (75-degree specular glossiness $G_s$ (75°)) of each solid image by the glossmeter "VGS-1D" fabricated by Nippon Denshoku Co., Ltd.

Next the multi-regression analysis was performed using the above fixing condition data (heating roller temperature, pressing roller temperature, loaded nipping time, false nipping time, and loaded nipping surface pressure) as the explanatory variables and glossiness data of the fixed images as the object variable, a reference glossiness of 20° was set, and calculation was made of the values of constants A, B, C, D, E, and F in Expression (4). The resulting constant values were A=0.02976, B=0.00192, C=0.38931, D=0.02473, E=0.00385, and F=−9.747.

A total of one thousand fixing tests was made, each of which formed a 40 mm×40 mm rectangular solid image (with styrene acryl polymer toner of 1.0 mg/cm$^2$) on each piece of A4-size coated paper at a temperature of 20° C. and a relative humidity of 50% under conditions of the initial preset temperature of the heating roller (51) of 210° C., the preset temperature of the pressing roller (55) of 150° C., the loaded nipping width (L1) of 9.6 mm, the false nipping width (L2) of 15 mm, the moving speed (V) of the fixing belt (54) of 220 mm/sec, the loaded nipping area (L1×W) of 32.6 cm$^2$, the nipping load (P) of 657N, the loaded nipping time (c) of 44 m·sec, the false nipping time (d) of 63 m·sec, and the loaded nipping surface pressure (e) of 202 KPa. During the above fixing tests, calculation was made of the target heating roller temperature (a) by Expression (4) from the pressing roller temperature detected by the pressing roller temperature detecting means and controlled the power-on status of the halogen heater lamp (52) of the heating roller (51) according to the calculated target heating roller temperature (a).

Every ten fixings, measurement was made of the glossiness (75-degree specular glossiness $G_s$ (75°)) of the fixed image by the glossmeter "VGS-1D" fabricated by Nippon Denshoku Co., Ltd. The obtained glossiness of each test sample is the reference glossiness±2° or less. This means that the expected fixing performance is obtained steadily.

Example 4

The same test was made as Example 2 except the following: the initial preset temperature of the heating roller (51) of 205° C., the preset temperature of the pressing roller (55) of 150° C., the loaded nipping time (c) of 46 m·sec, the false nipping time (d) of 73 m·sec, and the loaded nipping surface pressure (e) of 216 KPa. The obtained glossiness (75-degree specular glossiness $G_s$ (75°)) of each test sample is the reference glossiness±2° or less. This means that the expected fixing performance is obtained steadily even when the fixing condition is changed.

In accordance with the fixing device controlling method of the present invention, the target heating roller temperature is set optimum corresponding to the actually detected pressure roller temperature considering the loaded nipping time, the false nipping time, and the loaded nipping surface pressure. Therefore, the subsequent fixing process can be executed with the temperature of the nipping area optimized. Accordingly, this enables the fixing device to keep the desired fixing performance steadily for a long time independently of the change in the fixing condition and operating environment.

In accordance with the fixing device of the present invention, thanks to the above controlling method, the fixing device can keep the desired fixing performance steadily for a long time independently of the change in the fixing condition and operating environment.

In accordance with the image forming apparatus of the present invention, thanks to the above fixing device, the apparatus can keep the desired fixing performance steadily for a long time independently of the change in the fixing condition and operating environment. Accordingly, fixed images of uniform glossiness can be obtained steadily.

<Embodiment 3>

The image forming apparatus of this embodiment has the same configuration as that of Embodiment 1 except the following:

The control mechanism has a function of setting a target glossiness of fixed images and a function of setting a target heating roller temperature (a) from the preset glossiness of fixed images, a detected temperature (b) of the pressing roller obtained by the temperature detecting means 48, a loaded nipping time (c) calculated by Expression (1), a false nipping time (d) calculated by Expression (2), and a loaded nipping surface pressure (e) calculated by Expression (3). Substantially, the target heating roller temperature (a) is calculated by the expression (4') below.

$$\text{Loaded nipping time } (c)=L1/V \qquad \text{Expression (1)}$$

$$\text{False nipping time } (d)=L2/V \qquad \text{Expression (2)}$$

$$\text{Loaded nipping surface pressure } (e)=P/(L1\times W) \qquad \text{Expression (3)}$$

$$ln[G/(100-G)]=A\times\text{target heating roller temperature } (a)+B\times\text{detected pressure roller temperature } (b)+C\times\text{loaded nipping time } (c)+D\times\text{false nipping time } (d)+E\times\text{loaded nipping surface pressure } (e)+F=0 \qquad \text{Expression (4)}$$

In Expressions (1) to (3), L1 is the width of the fixing belt along the movement of the fixing belt in the surface area (or the loaded nipping area N1) of the fixing belt 44 sandwiched by the pressing roller 45 and the supporting roller 43.

L2 is the width of the fixing belt in the area (or the false nipping area N2) in contact with the pressing roller 45 only along the movement of the fixing belt 44.

V is the moving speed of the fixing belt 44.

W is the width of the fixing belt 44 perpendicular to the movement of the fixing belt 44 in the loaded nipping area N1.

P is the load (or the nipping load) applied to the area of the fixing belt 44 sandwiched by the pressing roller 45 and the supporting roller 43.

In above Expression (4'), A, B, C, D, E, and F are all constants and G is a preset glossiness of fixed images. The constants A, B, C, D, E, and F are set as explained below.

Constants A, B, C, D, E, and F are calculated by the steps of fixing unfixed toner images on a plurality of recording materials while varying the heating roller temperature, the pressing roller temperature, the loaded nipping time, the false nipping time, and the loaded nipping surface pressure, forming solid images on the recording materials, measuring the glossiness of the fixed solid images, performing the multi-regression analysis using the above fixing condition data (substantially values of the heating roller temperature, the pressing roller temperature, the loaded nipping time, false nipping time, and the loaded nipping surface pressure) as the explanatory variables and glossiness data of the fixed images (substantially the value of 1 n (measured glossiness/100−measured glossiness]) as the object variable, and calculating the values of the constants A, B, C, D, E, and F.

Such a control mechanism controls the thermal status of the heating roller 41 as explained below.

The thermal status controlling comprises the steps of entering a target glossiness of fixed images into the control mechanism, turning on the halogen heater lamp 42 in the heating roller 41 and the halogen heater lamp 46 in the pressing roller 45 by the heater lamp power-on control mechanism (not visible in the drawing), warming up the heating roller 41 to the preset initial heating roller temperature (a0) and the pressing roller 45 to the preset pressing roller temperature (b0) (wherein the preset initial heating roller temperature (a0) is a temperature at which fixing is executable unlike the target heating roller temperature (a) for actual fixing), calculating the target heating roller temperature (a) by Expression (4) when the heating roller 41 reaches the preset initial heating roller temperature (a0) and the pressing roller 45 reaches the preset pressing roller temperature (b0), and controlling the power-on status of the halogen heater lamp 42 in the heating roller 41 by the preset target heating roller temperature (a) and the halogen heater lamp 46 in the pressing roller 45 by the preset temperature.

In more detail, the control mechanism stores in advance the values of constants A, B, C, D, E, and F for Expression (4) under various operating environments and determines the fixing condition (the preset initial heating roller temperature (a0), the preset pressing roller temperature (b0), the loaded nipping time (c), the false nipping time (d), and the loaded nipping surface pressure (e) for example by Expression (5) according to the glossiness G of fixed images which are entered into the control mechanism.

$$ln[G/(100-G)]=A\times\text{preset initial heating roller temperature } (a0)+B\times\text{preset pressing roller temperature } (b0)+C\times\text{loaded nipping time } (c)+D\times\text{false nipping time } (d)+E\times\text{loaded nipping surface pressure } (e)+F \qquad \text{Expression (5)}$$

The fixing conditions can be acceptable as far as they substantially satisfy the above Expression (5). The preferable values of factors in the fixing conditions are a preset initial heating roller temperature (a0) of 180 to 230° C., a preset pressing roller temperature (b0) of 120 to 170° C., a loaded nipping time (c) of 20 to 67 m·sec, a false nipping time (d) of 0 to 84 m·sec, and a loaded nipping surface pressure (e) of 98 to 470 KPa. The preferable values of the other factors in the fixing conditions are loaded nipping width (L1: longitudinal width of the fixing belt 44 in the loaded nipping area N1) of 5 to 12 mm, false nipping width (L1: longitudinal width of the fixing belt 44 in the false nipping area N2) of 0 to 15 mm, moving speed of the fixing belt 44 of 180 to 250 mm/sec, nipping load P of 400 to 800 N and loaded nipping area N1 of 17 to 41 $cm^2$.

When determining a fixing condition, it is possible to give a fixed value in advance to at least one of the preset initial heating roller temperature (a0), the preset pressing roller temperature (b0), the loaded nipping time (c), the false nipping time (d), and the loaded nipping surface pressure (e), and to determine the values of the other factors according to the entered glossiness value.

Figure 6:
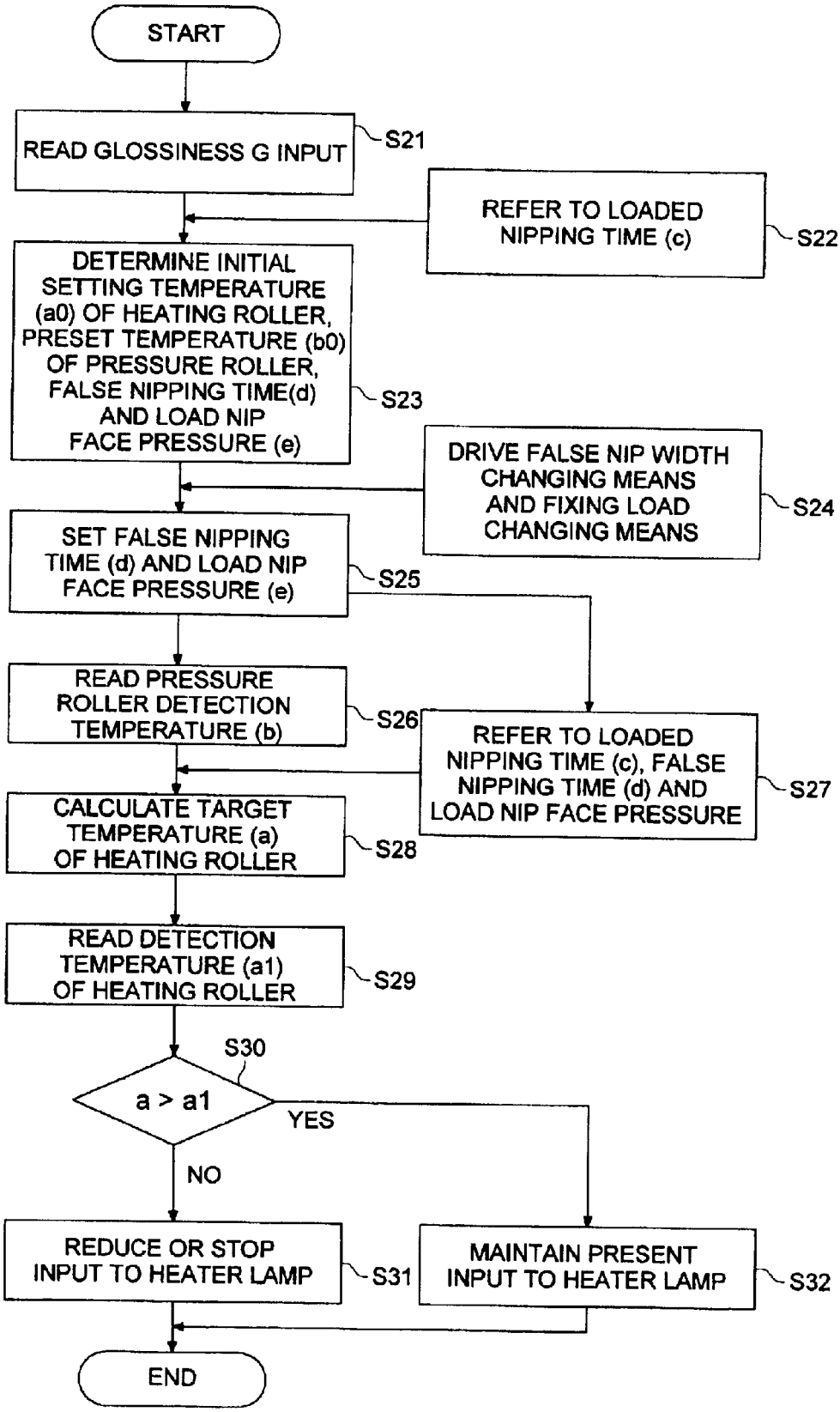
FIG. 6 shows a flow chart of a control method which is still another embodiment of the present invention.

For example, let's treat the loaded nipping time (c) as a fixed value. As shown in FIG. 6, when reading the entered glossiness G (Step S21), the control mechanism refers to the preset loaded nipping time (c) (Step S22), determines the preset initial heating roller temperature (a0), the preset pressing roller temperature (b0), the false nipping time (d), and the loaded nipping surface pressure (e) (Step S23), drives the false nipping width changing means and the fixing load changing means according to the determined false nipping time (d) and the loaded nipping surface pressure (e) (Step S24), changes the longitudinal width of the fixing belt 44 in the false nipping area N2 and the load applied to the loaded nipping area N1, and sets the actual false nipping time and the loaded nipping surface pressure in the mechanism (Step S25).

When the temperature of the heating roller 41 reaches the preset initial heating roller temperature (a0) and the temperature of the pressing roller 45 reaches the preset pressing roller temperature (b0), the pressing roller temperature detecting means 48 starts to detect the temperature of the outer circumferential surface of the pressing roller 45 and sends the detected pressing roller temperature (b) to the control mechanism (Step S26). Similarly, the heating roller temperature detecting means 47 detects the temperature of the outer circumferential surface of the heating roller 41 in synchronism with the detection of the temperature of the pressing roller 45.

The control mechanism refers to the preset loaded nipping time (c), the false nipping time (d), and the loaded nipping surface pressure (e) (Step S27) and calculates the target heating roller temperature (a) by Expression (4) using the constants A, B, C, D, E, and F (Step S28).

Then, the control mechanism reads the detected heating roller temperature (a1) from the heating roller temperature detecting means 47 (Step S29) and compares the temperature (a1) with the target heating roller temperature (a) in the decision block (in Step S30). When the detected temperature (a1) is higher than the target heating roller temperature (a), the control mechanism reduces or stops power to the halogen heater lamp 42 (Step S31). In the other case, the control mechanism keeps on lighting the halogen heater lamp 42 (Step S32).

Similarly, the pressing roller temperature (b) detected by the pressing roller temperature detecting means 48 is compared with the preset temperature of the pressing roller 45. When the detected pressing roller temperature (b) is higher than the preset pressing roller temperature, the control mechanism reduces or stops power to the halogen heater lamp 46. In the other case, the control mechanism keeps on lighting the halogen heater lamp 46.

These steps are repeated to control the power-on status of the halogen heater lamps 42 and 46. Consequently, image fixing is carried out with the nipping area N kept at an optimum temperature fit for the operating environment.

In accordance with the above image forming apparatus, the fixing device 40 controls according to the glossiness G of fixed images considering fixing conditions containing factors that greatly affect the glossiness of fixed images such as the heating roller temperature, the pressing roller temperature, the loaded nipping time (c), the false nipping time (d), and the loaded nipping surface pressure (e). Therefore, the fixing device can easily form fixed images of a desired glossiness.

Further, as the target heating roller temperature (a) is calculated according to the actually-detected pressure roller temperature (b) and the operating status of the heat source in the heating roller is controlled according to the target heating roller temperature (a), the target heating roller temperature (a) is kept at an optimum temperature even when the temperature of the pressing roller 45 changes. Accordingly, the nipping area is always kept at an optimum temperature and fixed images of a desired glossiness can be formed steadily.

Further, when the fixing conditions such as the nipping width change as the time goes by, the target heating roller temperature (a) is set according to the quantity of variation. Therefore, the fixing device can steadily form fixed images of desired glossiness for a long time.

Further in the present invention, the constants A to F in Expression (4') are changed according to the ambient temperature and humidity and the target heating roller temperature (a) can be set using the new constants A to F in Expression (4'). Substantially, the control method of the present invention takes the steps of changing the operating environment (ambient temperature and humidity) in preset temperature and humidity ranges, calculating values of constants A to F in Expression (4') in respective operating environments, storing each set of constants A to F in the memory block of the control mechanism, detecting the ambient temperature and humidity by the operating environment detecting means, selecting the related operating environment constants from those stored in the memory block according to the detected temperature and humidity, changing thereof, and calculating the target heating roller temperature (a) by Expression (4') using the new constants.

In accordance with the above control method, the fixing process can be carried out to get fixed images of a target glossiness with the temperature of the nipping block N controlled at an optimum temperature fit for the actual fixing operation even when the environmental condition varies because values of constants in Expression (4') vary according to the actual operating environment. Therefore, fixed images of a desired glossiness can be steadily obtained independently of the operating environment.

<Embodiment 4>

The configuration of this image forming apparatus is the same as that of the image forming apparatus of Embodiment 3 except the fixing device. The major difference is mainly explained below.

The fixing device 50 comprises a heating roller 51 containing a halogen heater lamp 52 as a heat source, a supporting roller 53A that is in parallel with the heating roller 51 with a space between the rollers 51 and 53A, a supporting roller 53B that is in parallel with the rollers 51 and 53A with a space therebetween, an endless fixing belt 54 that is trained about the heating roller 51 and the supporting rollers 53A and 53B, and a pressing roller 55 containing a halogen heater lamp 56 as a heat source which is placed to form a nipping area N between the fixing belt 54 and the pressing roller 55 by pressing the heating roller 51 via the fixing belt 54. The nipping area N contains a loaded nipping area N1 at which the fixing belt 54 is pincer-pressed by the heating roller 51 and the pressing roller 55 and a false nipping area N2 at which the fixing belt 54 is in contact with the pressing roller 55 only. In this example, the false nipping area N2 is in the downstream side of the loaded nipping area N1. The first supporting roller 53A has a function (as a separation roller) to separate the fixing belt 54 from the pressing roller 55 and a function (as a tension roller) to give a specified tension to the fixing belt 54. These functions can control the false nipping width and the tension of the fixing belt 54 by moving the first supporting roller 53A.

Further the fixing device 50 contains a means 57 for detecting the temperature of the heating roller 51 in contact with or very closely to the surface of the heating roller 51 and another means 58 for detecting the temperature of the pressing roller 55 in contact with or very closely to the surface of the pressing roller 55.

The fixing device 50 is equipped with a means (not visible in the drawing) for changing the load upon the loaded nipping area N1 and another means (not visible in the drawing) for changing the false nipping width by moving the first supporting roller 53A.

Further, the fixing device 50 has a control mechanism (not visible in the drawing) to control the power-on status of the halogen heater lamp 52 in the heating roller 51 and the halogen heater lamp 56 in the pressing roller 55.

Each of the first and second supporting rollers 53A and 53B comprises a metallic cylinder which extends across the recording material.

The metallic cylinders constituting the supporting rollers 53A and 53B can be made of any metal. Substantially, the metal can be selected for example from a group of aluminum, iron, copper, and their alloys.

The configuration of the heating roller 51, the fixing belt 54, and the pressing roller 55 of this embodiment is the same as those (the heating roller 41, the fixing belt 44, and the pressing roller 45) of Embodiment 1.

The control mechanism has a function to set a glossiness of fixed images to be formed and a function to set a target heating roller temperature (a) from a preset glossiness of fixed images, a detected temperature (b) of the pressing roller obtained by said temperature detecting means 58, a loaded nipping time (c) calculated by Expression (1), a false nipping time (d) calculated by Expression (2), and a loaded nipping surface pressure (e) calculated by Expression (3), and substantially controls the target heating roller temperature (a) by Expression (4).

$$\text{Loaded nipping time } (c) = L1/V \qquad \text{Expression (1)}$$

$$\text{False nipping time } (d) = L2/V \qquad \text{Expression (2)}$$

$$\text{Loaded nipping surface pressure } (e) = P/(L1 \times W) \qquad \text{Expression (3)}$$

$$ln[G/(100-G)] = A \times \text{target heating roller temperature } (a) + B \times \text{detected pressure roller temperature } (b) + C \times \text{loaded nipping time } (c) + D \times \text{false nipping time } (d) + E \times \text{loaded nipping surface pressure } (e) + F \qquad \text{Expression (4')}$$

In Expressions (1) to (3), L1 is the width of the fixing belt 54 along the movement of the fixing belt 54 in the surface area (or the loaded nipping area N1) of the fixing belt 54 sandwiched by the heating roller 51 and the pressing roller 55, L2 is the width of the fixing belt 54 in the area (or the false nipping area N2) in contact with the pressing roller 55 only along the movement of the fixing belt 54. V is the moving speed of the fixing belt 54, W is the width of the fixing belt 54 perpendicular to the movement of the fixing belt 54 in the loaded nipping area N1, and P is the load (or the nipping load) applied to the area of the fixing belt 54 sandwiched by the heating roller 51 and the pressing roller 55.

In the above Expression (4'), constants A, B, C, D, E, and F are all set in the same manner as in Embodiment 1. G is a preset glossiness of fixed images.

This control mechanism controls the thermal status of the heating roller 51 in the same manner as in Embodiment 3.

In accordance with the above image forming apparatus, as the fixing device 50 is controlled according to a preset glossiness of fixed images considering factors that greatly affect the glossiness of fixed images, such as the heating roller temperature, the pressing roller temperature, the loaded nipping time (c), the false nipping time (d), and the loaded nipping surface pressure (e), fixed images of a desired glossiness can be easily formed.

Further, the fixing device calculates the target heating roller temperature (a) from the actually-detected pressing roller temperature (b) and controls the operating status of the heat source in the heating roller by the temperature (a). Accordingly, even when the actual temperature of the pressing roller 55 varies, the target heating roller temperature (a) is controlled to an optimum temperature according to the change of the temperature and the nipping area N is always kept at an optimum temperature. As the result, fixed images of a desired glossiness can be steadily formed.

Furthermore, when the fixing condition such as a nipping width varies as the time goes by, the target heating roller temperature (a) is controlled according to the quantity of variation. With this, the fixing device can steadily form fixed images of desired glossiness for a long time.

<Embodiment 5>

A fixing device (40) was prepared using the same components as those used for Embodiment 1 according to the configuration shown in FIG. 2 and further an image forming apparatus was prepared using this fixing device (40) as shown in FIG. 1. The major difference is mainly explained below.

A trial was made to form a 40 mm×40 mm rectangular solid image (with styrene acryl polymer toner of 1.0 mg/cm$^2$) on each piece of A4-size coated paper at a temperature of 20° C. and a relative humidity of 50% by changing the heating roller temperature, the pressing roller temperature, the loaded nipping time, the false nipping time, and the loaded nipping surface pressure and measurement was made of the glossiness (75-degree specular glossiness $G_s$ (75°)) of each solid image by the glossmeter "VGS-1D" fabricated by Nippon Denshoku Co., Ltd.

Next the multi-regression analysis was performed using the above fixing condition data (heating roller temperature, pressing roller temperature, loaded nipping time, false nipping time, and loaded nipping surface pressure) as the explanatory variables and the value of 1 n (glossiness/(100−glossiness)) obtained by the glossiness data of fixed images as the object variable, and calculation was made of the values of constants A, B, C, D, E, and F in Expression (4). The resulting constant values were A=0.02471, B=0.01121, C=0.244, D=0.02501, E=0.0202, and F=−11.1.

A total of one thousand fixing tests was made, each of which formed a 40 mm×40 mm rectangular solid image (with styrene acryl polymer toner of 1.0 mg/cm$^2$) on each piece of A4-size coated paper at a temperature of 20° C. and a relative humidity of 50% under conditions (1) to (4) listed below and conditions of a preset glossiness G of fixed images, a preset initial temperature of the heating roller (a0), a preset temperature of the pressing roller (b0), a preset loaded nipping time (c), a preset false nipping time (d), and a preset loaded nipping surface pressure (e). During the above fixing tests, we calculated the target heating roller temperature (a) by Expression (4') from the pressing roller temperature (b) detected by the pressing roller temperature detecting means and controlled the power-on status of the halogen heater lamp (42) in the heating roller (41) according to the calculated target heating roller temperature (a). Every ten fixings, we measurement was made of the glossiness (75-degree specular glossiness $G_s$ (75°)) of the fixed image by the glossmeter "VGS-1D fabricated by Nippon Denshoku Co., Ltd.

The obtained glossiness of each test sample is the reference glossiness G±2° or less under any of the conditions (1)

to (4'). This means that the expected fixing performance is obtained steadily.

TABLE 1

| | Condition (1) | Condition (2) | Condition (3) | Condition (4) |
|---|---|---|---|---|
| Glossiness G [°] | 20 | 30 | 40 | 50 |
| Fixing condition | | | | |
| Preset initial temperature of the heating roller (a0) [° C.] | 210 | 210 | 210 | 220 |
| Preset temperature of the pressing roller (b0) [° C.] | 140 | 140 | 150 | 155 |
| Preset loaded nipping time (c) [m · sec] | 37 | 46 | 55 | 55 |
| Preset false nipping time (d) [m · sec] | 32 | 46 | 50 | 50 |
| Preset loaded nipping surface pressure (e) [KPa] | 200 | 200 | 220 | 220 |

<Embodiment 6>

A fixing device (50) was prepared using the same components as those used for Embodiment 3 according to the configuration shown in FIG. 5 and further an image forming apparatus was prepared using this fixing device (50) in the same manner as Embodiment 5. The major difference is mainly explained below.

A total of one thousand fixing tests was made, each of which formed a 40 mm×40 mm rectangular solid image (with styrene acryl polymer toner of 1.0 mg/cm$^2$) on each piece of A4-size coated paper at a temperature of 20° C. and a relative humidity of 50% under conditions (5) to (8) listed below and conditions of a preset glossiness G of fixed images, a preset initial temperature of the heating roller (a0), a preset temperature of the pressing roller (b0), a preset loaded nipping time (c), a preset false nipping time (d), and a preset loaded nipping surface pressure (e). During the above fixing tests, we calculated the target heating roller temperature (a) by Expression (4') from the pressing roller temperature (b) detected by the pressing roller temperature detecting means and controlled the power-on status of the halogen heater lamp (52) in the heating roller (51) according to the calculated target heating roller temperature (a).

Every ten fixings, measurement was made of the glossiness (75-degree specular glossiness $G_s$ (75°)) of the fixed image by the glossmeter "VGS-1D" fabricated by Nippon Denshoku Co., Ltd. The obtained glossiness of each test sample is the reference glossiness G±2° or less under any of the conditions (5) to (8). This means that the expected fixing performance is obtained steadily.

TABLE 2

| | Condition (1) | Condition (2) | Condition (3) | Condition (4) |
|---|---|---|---|---|
| Glossiness G [°] | 20 | 30 | 40 | 50 |
| Fixing condition | | | | |
| Preset initial temperature of the heating roller (a0) [° C.] | 210 | 220 | 220 | 220 |
| Preset temperature of the pressing roller (b0) [° C.] | 150 | 160 | 165 | 170 |
| Preset loaded nipping time (c) [m · sec] | 50 | 55 | 65 | 75 |
| Preset false nipping time (d) [m · sec] | 50 | 60 | 75 | 80 |
| Preset loaded nipping surface pressure (e) [KPa] | 250 | 260 | 300 | 300 |

In accordance with the fixing device controlling method of the present invention, as the fixing device is controlled according to a preset glossiness of fixed images considering factors that greatly affect the glossiness of fixed images, such as the heating roller temperature, the pressing roller temperature, and the loaded nipping time (c), the false nipping time (d), and the loaded nipping surface pressure (e) that are calculated by Expressions (1) through (3), the fixing device can easily form fixed images of desired glossiness. Further, the fixing device calculates the target heating roller temperature (a) from the actually-detected pressing roller temperature (b) and controls the operating status of the heat source in the heating roller by the temperature (a) to keep the nipping area at an optimum temperature. With this, the fixing device can steadily form fixed images of desired glossiness.

When the fixing condition such as a nipping width varies as the time goes by, the target heating roller temperature (a) is set according to the quantity of variation. With this, the fixing device can steadily form fixed images of desired glossiness for a long time.

In accordance with the fixing device of the present invention, because such a method that described above is implemented, fixed images of a desired glossiness can be formed easily and steadily for a long time. Further, such fixed images can be formed independently of changes in the operating environment.

In accordance with the image forming apparatus of the present invention, because it is equipped with said fixing device, fixed images of a desired glossiness can be formed easily and steadily for a long time. Further, such fixed images can be formed independently of changes in the operating environment.

What is claimed is:

1. A method of controlling a fixing device comprising a heating roller containing a heat source, at least one supporting roller that is provided in parallel with and spaced from the heating roller, a fixing belt that is trained about the heating roller and the supporting roller, and a pressing roller that is placed to form a nipping area between the fixing belt and the pressing roller and that provides a pressing force to the heating roller or the supporting roller through the fixing belt, the method comprising:

(a) presetting a desired glossiness of fixed images;

(b) detecting a temperature of the pressing roller;

(c) calculating a target heating roller temperature from at least the preset glossiness of fixed images, the detected temperature of the pressing roller, a loaded nipping time, a false nipping time, and a loaded nipping surface pressure; and (d) controlling an operating status of the heat source in the heating roller according to the calculated target heating roller temperature; wherein the loaded nipping time is calculated by an expression (1): Loaded nipping time=L1/V, wherein the false nipping time is calculated by an expression (2): False nipping time=L2/V, wherein the loaded nipping surface pressure is calculated by an expression (3): Loaded nipping surface pressure=P/(L1×W), wherein L1 represents a width of the fixing belt along movement of the fixing belt in a surface area of the fixing belt interposed between the pressing roller and the supporting roller or the heating roller, L2 represents the width of the fixing belt in an area in contact with the pressing roller only along the movement of the fixing belt, V represents a moving speed of the fixing belt, W represents the width of the fixing belt perpendicular to the movement of the fixing belt in the surface area of the fixing belt interposed between the pressing roller and a supporting roller or the heating roller and P represents a load applied to the area interposed between the pressing roller and the supporting roller or the heating roller, wherein the target heating roller temperature is calculated by satisfying Expression (4): ln(G/(100−G))=A×target heating roller temperature+B×detected pressure roller temperature+C×loaded nipping time+D×false nipping time+E×loaded nipping surface pressure+F, and wherein A, B, C, D, E, and F are all constants and G is the preset glossiness of fixed images.

2. The method of claim 1, wherein the temperature of the pressing roller is detected by detecting an ambient temperature and humidity and changing the constants in the expression (4) according to a result of the detecting.

3. A method of controlling a fixing device comprising a heating roller containing a heat source, at least one supporting roller that is provided in parallel with and spaced from the heating roller, a fixing belt that is trained about the heating roller and the supporting roller, and a pressing roller that is placed to form a nipping area between the fixing belt and the pressing roller and that provides a pressing force to the heating roller or the supporting roller through the fixing belt, the method comprising:

(a) presetting a desired glossiness of fixed images;

(b) detecting a temperature of the pressing roller;

(c) calculating a target heating roller temperature from at least the preset glossiness of fixed images, the detected temperature of the pressing roller, a loaded nipping time, a false nipping time, and a loaded nipping surface pressure; and (d) controlling an operating status of the heat source in the heating roller according to the calculated target heating roller temperature;

wherein the loaded nipping time is calculated by an expression (1): Loaded nipping time=L1/V, wherein the false nipping time is calculated by an expression (2) False nipping time=L2/V, wherein the loaded nipping surface pressure is calculated by an expression (3): Loaded nipping surface pressure=P/(L1×W), wherein L1 represents a width of the fixing belt along movement of the fixing belt in a surface area of the fixing belt interposed between the pressing roller and the supporting roller or the heating roller, L2 represents the width of the fixing belt in an area in contact with the pressing roller only along the movement of the fixing belt, V represents a moving steed of the fixing belt, W represents the width of the fixing belt perpendicular to the movement of the fixing belt in the surface area of the fixing belt interposed between the pressing roller and the supporting roller or the heating roller, and P represents a load applied to the area interposed between the pressing roller and the supporting roller or the heating roller, and further comprising an additional step of actually measuring an L1 value in the Expressions (1) and (3) and an L2 value in the Expression (2), wherein the loaded nipping time, the false nipping time, and the loaded nipping surface pressure are calculated from a result of the actual measuring.

4. A fixing device comprising:

(a) a heating roller containing a heat source;

(b) at least one supporting roller provided in parallel with and spaced apart from the heating roller;

(c) a fixing belt trained about the heating roller and the supporting roller;

(d) a pressing roller placed to form a nipping area between the fixing belt and the pressing roller for applying a pressing force to the heating roller or the supporting roller through the fixing belt;

(e) a temperature detector for detecting a temperature of the pressing roller; and (f) a controller for controlling an operating status of the heating source in the heating roller, wherein the controller: (i) presets a glossiness of fixed images to be formed, (ii) calculates a target heating roller temperature at least from a preset fixed image glossiness, a detected temperature of the pressing roller obtained by the temperature detector, a loaded nipping time, a false nipping time, and a loaded nipping surface pressure, and (iii) controls an operating status of the heat source in the heating roller according to the target heating roller temperature, wherein the loaded nipping time is calculated by an expression (1): Loaded nipping time=L1/V, wherein the false nipping time is calculated by an expression (2): False nipping time=L2/V, wherein the loaded nipping surface pressure is calculated by an expression (3): Loaded nipping surface pressure=P/(L1×W), wherein L1 represents a width of the fixing belt along movement of the fixing belt in a surface area of the fixing belt interposed between the pressing roller and the supporting roller or the heating roller, L2 represents the width of the fixing belt in an area in contact with the pressing roller only along the movement of the fixing belt, V represents a moving speed of the fixing belt, W represents the width of the fixing belt perpendicular to the movement of the fixing belt in the surface area of the fixing belt interposed between the pressing roller and the supporting roller or the heating roller, and P represents a load applied to the area interposed between the pressing roller and the supporting roller or the heating roller, wherein the controller calculates the target heating roller temperature by an expression (4): $\ln(G/(100-G)=A\times$ target heating roller temperature$+B\times$detected pressure roller temperature$+C\times$loaded nipping time$+D\times$false nipping time$+E\times$loaded nipping surface pressure$+F$, and wherein A, B, C, D, E, and F are all constants and G is the preset glossiness of fixed images.

5. The fixing device of claim 4, further comprising an operating environment detector for detecting an ambient temperature and humidity, wherein the controller has a function to change the constants in Expression (4) according to the ambient temperature and humidity detected by the operating environment detector.

6. An image forming apparatus comprising the fixing device of claim 5.

7. An image forming apparatus comprising the fixing device of claim 4.

8. A fixing device comprising:

(a) a heating roller containing a heat source;

(b) at least one supporting roller provided in parallel with and spaced apart from the heating roller;

(c) a fixing belt trained about the heating roller and the supporting roller;

(d) a pressing roller placed to form a nipping area between the fixing belt and the pressing roller for applying a pressing force to the heating roller or the supporting roller through the fixing belt;

(e) a temperature detector for detecting a temperature of the pressing roller; and (f) a controller for controlling an operating status of the heat source in the heating roller, wherein the controller: (i) presets a glossiness of fixed images to be formed, (ii) calculates a target heating roller temperature at least from a preset fixed image glossiness, a detected temperature of the pressing roller obtained by the temperature detector, a loaded nipping time, a false nipping time, and a loaded nipping surface pressure, and (iii) controls an operating status of the heat source in the heating roller according to the target heating roller temperature, wherein the loaded nipping time is calculated by an expression (1): Loaded nipping time$=L1/V$, wherein the false nipping time is calculated by an expression (2): False nipping time$=L2/V$, wherein the loaded nipping surface pressure is calculated by an expression (3): Loaded nipping a surface pressure$=P/(L1\times W)$, wherein L1 represents a width of the fixing belt along movement of the fixing belt in a surface area of the fixing belt interposed between the pressing roller and the supporting roller or the heating roller, L2 represents the width of the fixing belt in an area in contact with the pressing roller only along the movement of the fixing belt, V represents a moving speed of the fixing belt, W represents the width of the fixing belt perpendicular to the movement of the fixing belt in the surface area of the fixing belt interposed between the pressing roller and the supporting roller or the heating roller, and P represents a load applied to the area interposed between the pressing roller and the supporting roller or the heating roller, wherein the controller has a function to receive at least an L1 value for the Expressions (1) and (3) and an L2 value for the Expression (2), and to calculate the loaded nipping time, the false nipping time, and the loaded nipping surface pressure from the received L1 and L2 values.

9. An image forming apparatus comprising the fixing device of claim 8.

* * * * *